United States Patent [19]

Hollyday et al.

[11] Patent Number: 4,690,479

[45] Date of Patent: Sep. 1, 1987

[54] FILTERED ELECTRICAL HEADER ASSEMBLY

[75] Inventors: Robert D. Hollyday, Elizabethtown; Patrick F. Yeager, Middletown, both of Pa.

[73] Assignee: AMP Incorporated, Harrisburg, Pa.

[21] Appl. No.: 786,392

[22] Filed: Oct. 10, 1985

[51] Int. Cl.[4] ..... H01R 13/44

[52] U.S. Cl. ..... 439/97; 439/101

[58] Field of Search ..... 339/14 R, 143 R, 147 R; 333/181, 183, 184, 185

[56] References Cited

U.S. PATENT DOCUMENTS

| | | | |
|---|---|---|---|
| Re. 29,258 | 6/1977 | Fritz | 333/70 S |
| 3,538,464 | 11/1970 | Walsh | 333/79 |
| 3,961,294 | 6/1976 | Hollyday | 333/79 |
| 4,020,430 | 4/1977 | Vander Heyden | 333/79 |
| 4,083,022 | 4/1978 | Nijman | 333/79 |
| 4,126,840 | 11/1978 | Selvin | 333/79 |
| 4,187,481 | 2/1980 | Boutros | 333/182 |
| 4,195,272 | 3/1980 | Boutros | 333/182 |
| 4,212,510 | 7/1980 | Ritchie | 339/147 R |
| 4,215,326 | 7/1980 | Hollyday | 333/182 |
| 4,222,626 | 9/1980 | Hollyday et al. | 339/147 R |
| 4,262,268 | 4/1981 | Shimada et al. | 333/182 |
| 4,264,116 | 4/1981 | Gliha, Jr. | 339/89 M |
| 4,265,506 | 5/1981 | Hollyday | 339/147 R |
| 4,376,922 | 3/1983 | Muzslay | 333/182 |
| 4,491,376 | 1/1985 | Gladd et al. | 339/9 E |
| 4,512,618 | 4/1985 | Kumar | 339/143 R X |
| 4,589,720 | 5/1986 | Aujla et al. | 333/185 X |

OTHER PUBLICATIONS

"AMP Quiet Line Filter Handbook", AMP Incorporated, Harrisburg, Pa., 1978.

*Primary Examiner*—Eugene F. Desmond
*Attorney, Agent, or Firm*—Katherine A. Nelson

[57] ABSTRACT

A filtered electrical header assembly for circuit boards. The assembly includes a housing supporting a plurality of terminals, filter means electrically coupled to the terminals, grounding means coupled to the filter means, and at least one conductive fastener for attaching the grounding means to the housing, for providing a means for mounting the housing to a circuit board, and for providing a grounding path from the grounding means through the at least one fastener to the circuit board. Two embodiments are disclosed: one employing tubular filter elements surrounding conductor pins, another employing a monolithic planar capacitor in contact with conductor pins. The invention permits a filtering capability to be incorporated into a standardized header assembly without affecting standardization.

22 Claims, 9 Drawing Figures

FILTERED ELECTRICAL HEADER ASSEMBLY

FIELD OF THE INVENTION

The present invention relates generally to electrical connectors for circuit boards or the like, and, more particularly, to electrical header assemblies having a filtering capability incorporated therein.

BACKGROUND OF THE INVENTION

Electical header assemblies are often used to make electrical connection to a circuit board. One example of a header assembly that was developed for use in the auto industry is disclosed in U.S. Pat. No. 4,491,376 and comprises a one-piece dielectric housing supporting a plurality of conductor pins. One end of the conductor pins projects out of the housing and is bent downwardly at an angle of approximately 90° for electrical connection to the circuit board to which the header assembly is to be mounted. The circuit board is provided with a precise pattern of holes through which the bent ends of the conductor pins extend, and the pins are soldered or otherwise electrically connected to conductive paths on one or both sides of the board.

The opposite ends of the conductor pins are adapted to be mated with conductors in a connector member designed to be plugged into the header assembly housing to complete a plurality of electrical circuits through the connector member and header assembly.

It is often desirable to provide filtering of all or selected ones of the circuits connected through a header assembly, for example, to isolate those circuits from EMI or RFI interferences. For greatest convenience and flexibility, it is also desirable to incorporate the filtering structure within the header assembly; however, this has proven to be a problem due to limitations in size, available space, and packaging techniques.

Specifically, header assemblies, such as the one disclosed in U.S. Pat. No. 4,491,376, are frequently of fixed design to enable standardization; and any redesign of the header assembly to accommodate filtering structure must not change the positions of the conductor pins to an extent that would prevent the header assembly from being properly connected to a standardized printed circuit board or to a standardized connector member. Also, any redesign must not alter the general dimensions or configuration of the header assembly to a degree that would prevent it from fitting within the limiting space normally provided for it on the standardized circuit board.

In view of the difficulty of redesigning header assemblies to provide a filtering capability while maintaining standardization requirements, it has been the practice to incorporate the filtering structure on the printed circuit board. This is a less than satisfactory solution, however, as the filtering structure occupies valuable space on the printed circuit board which can often be put to better use and, in general, does not provide the flexibility that is desired.

SUMMARY OF THE INVENTION

According to the present invention, a filtered header assembly is provided which comprises a housing, a plurality of terminals supported within the housing, filter means electrically coupled to the plurality of terminals for filtering interference, grounding means electrically coupled to the filter means for dissipating the filtered interference, and at least one electrically conductive fastener for attaching the grounding means to the housing, which defines means for mounting the housing to a mounting surface and for providing a conductive path from the filter means through the grounding means and the at least one fastener to the mounting surface.

With the present invention, the filter means and the grounding means can be incorporated into the header assembly without significantly changing the external dimensions or configuration of the header assembly and without changing the positions of the terminals within the assembly. Thus, standardization of the header assembly can be maintained, and the assembly can be mounted to standardized circuits boards and be mated to standardized connector members. In addition, the header assembly is designed such that the grounding means is attached to the housing, the header assembly as a whole is mounted to the mounting surface, and a grounding path is provided from the grounding means to the mounting surface simultaneously in a single fastening operation. Thus, additional structure to ground the grounding means to the mounting surface or to attach the grounding means within the housing is unnecessary. This simplifies the design of the header assembly and generally permits manufacturing costs to be maintained at a reasonable level.

According to one presently preferred embodiment of the invention, the grounding means comprises a grounding plate having a plurality of holes within which are mounted a plurality of tubular filter elements. The terminals comprise conductor pins extending through the tubular filter elements and electrically connected thereto as by soldering. The grounding plate also includes grounding flanges having apertures which are positioned to be aligned with apertures in the housing, and the at least one fastener comprises a plurality of conductive rivets extended through the aligned apertures and through apertures in a printed circuit board to simultaneously attach the grounding plate to the housing, mount the assembly to the printed circuit board, and provide a conducting path to dissipate filtered energy through the grounding plate and rivets to the printed circuit board.

The housing is substantially identical in external configuration and size to the housing in the unfiltered header assembly disclosed in U.S. Pat. No. 4,491,376 except that it is composed of two housing portions between which the grounding plate and the tubular filter elements are supported and which are assembled after the grounding plate and filters are positioned into the assembly.

According to a second presently preferred embodiment of the invention, the filtering means comprises monolithic planar capacitors and the grounding means comprises grounding clips, each planar capacitor being associated with at least one grounding clip, one such capacitor and clip being associated with a cavity of the housing. The grounding clips each include a spring arm portion for providing electrical contact with the grounding pad of one of the monolithic planar capacitors and a grounding flange portion having an aperture adapted to be aligned with a mounting aperture in the housing. Rivets are extended through the aligned apertures in the clips and the housing to attach the clips to the housing. Conductive fastening means inserted into apertures in the rivets and aligned apertures in the circuit board to mount the assembly to the circuit board, and provide grounding paths from the grounding clips through the rivets to the printed circuit board. In this embodiment, the housing is a one-piece construction, but is also of an external size and configuration that maintains standardization requirements.

Further advantages and specific details of the invention will become apparent hereinafter in the following detailed description of the preferred embodiments taken in conjunction with the drawings.

DETAILED DESCRIPTION OF THE PREFERRED EMBODIMENTS

Figure 1:
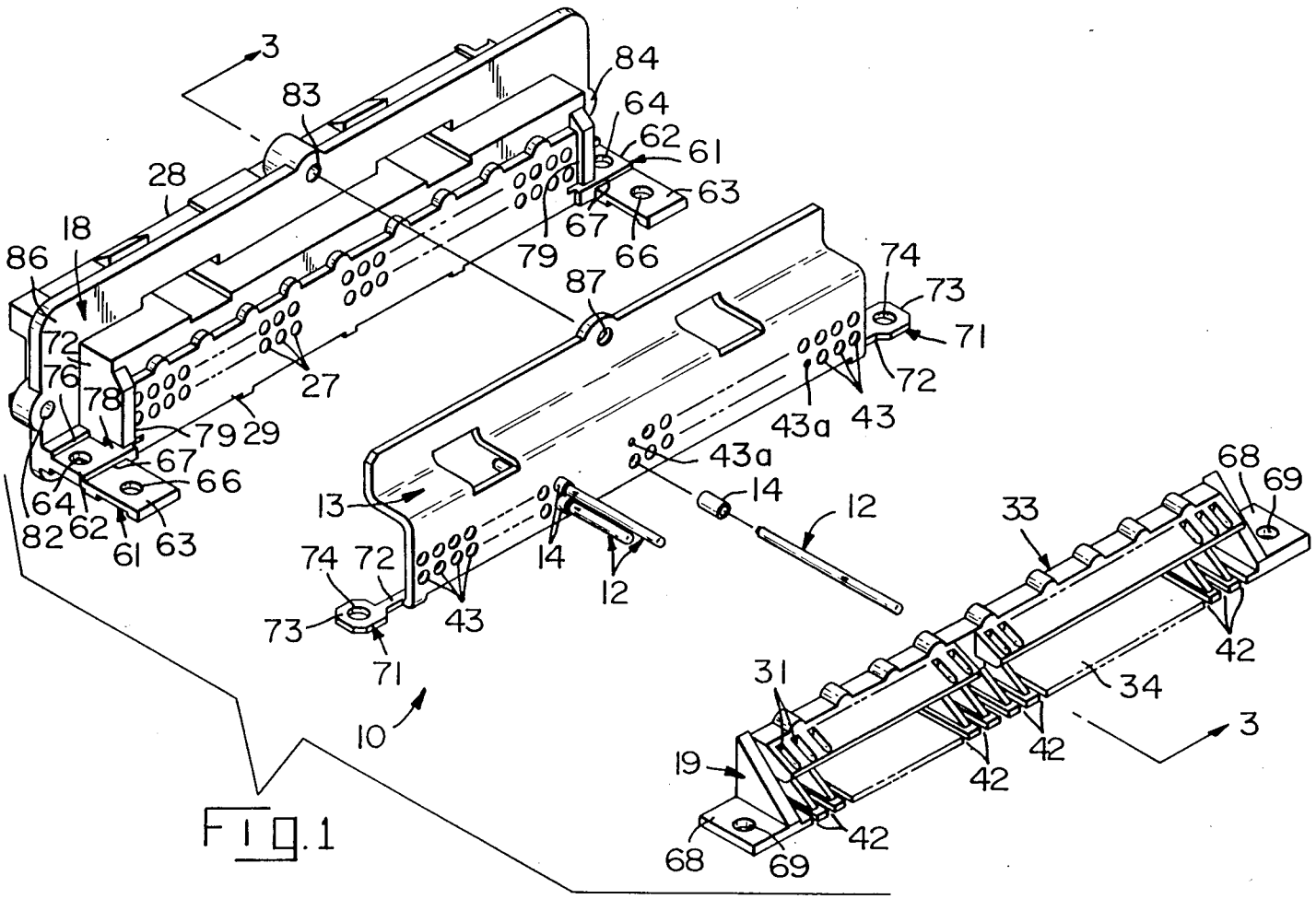
FIG. 1 is an exploded perspective view of a filtered header assembly according to one presently preferred embodiment of the invention.

FIGS. 1–4 illustrate a filtered electrical header assembly according to one presently preferred embodiment of the invention. The header assembly is generally designated by reference numeral 10 and includes a housing 11, a plurality of terminals comprising conductor pins 12 supported within the housing, grounding means comprising a grounding plate 13, filter means comprising a plurality of tubular filter elements 14 mounted to the grounding plate 13 and surrounding the plurality of conductor pins 12, and fasteners comprising a pair of rivets 16 for mounting the assembly 10 to a circuit board 17 or other support surface. As will be explained hereinafter, rivets 16 also function to attach the grounding plate 13 to the housing 11 and to provide a grounding path from the filter elements 14 to the printed circuit board.

Housing 11 comprises an elongated member formed in two parts: a front housing portion 18 of generally rectangular cross section, and a smaller, rear housing portion 19 of generally triangular cross section. Housing portions 18 and 19 are adapted to be assembled together to define housing 11 as will be explained hereinafter. Housing 11 is preferably formed of a dielectric material such as glass reinforced polyester or another suitable plastic material.

Figure 4:
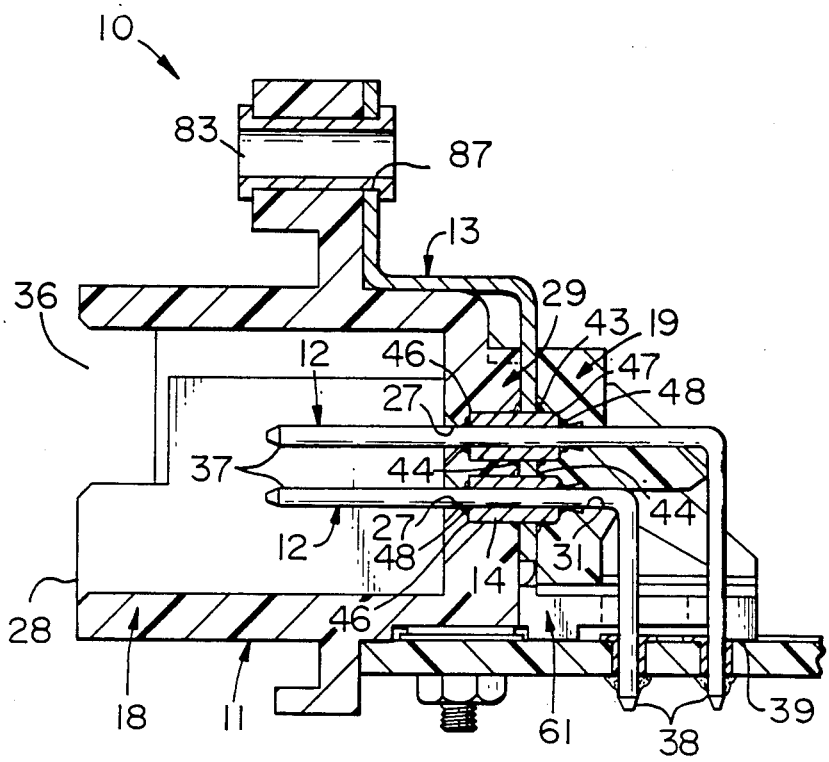
FIG. 4 is a cross-sectional view of the assembled header assembly of FIG. 2 taken along line 4—4 in FIG. 2.

Front housing portion 18 contains two rows of holes 27 which extend through housing portion 18 from the mating end 28 to grounding plate receiving surface 29 thereof. Rear housing portion 19 similarly contains two rows of holes 31 which extend through housing portion 19 from grounding plate receiving surface 33 to conductor end 34 thereof. The holes 27 and 31 are positioned within the housing portions 18 and 19 to be in precise alignment with one another when the housing portions are assembled together as best shown in FIG. 4. In the embodiments illustrated herein, the header assemblies contain two rows of 18 holes each to receive a like number of conductor pins 12 although it should be understood that this is exemplary only as different numbers of holes arranged in different ways could be provided, if desired.

The mating end 28 of front housing portion 18 is formed to define one or more sockets 36 (one socket being visible in FIGS. 3 and 4) for receiving mating connector members (not shown) to complete electrical circuits through the header assembly 10 as is known to those skilled in the art.

As best shown in FIG. 4 a conductor pin 12 extends through each of the aligned holes 27 and 31 in housing portions 18 and 19 with one end 37 of each pin extending into sockets 36 in front housing portion 18, and the opposite end 38 of each pin extending outwardly from conductor end 34 of rear housing portion 19. Conductor pins 12 can be formed of a variety of conductive materials such as tin plated brass and are preferably of round cross section and tapered at each end for ease in inserting the pins into holes in the printed circuit board and into appropriate female conductors in the mating connector member.

Figure 2:
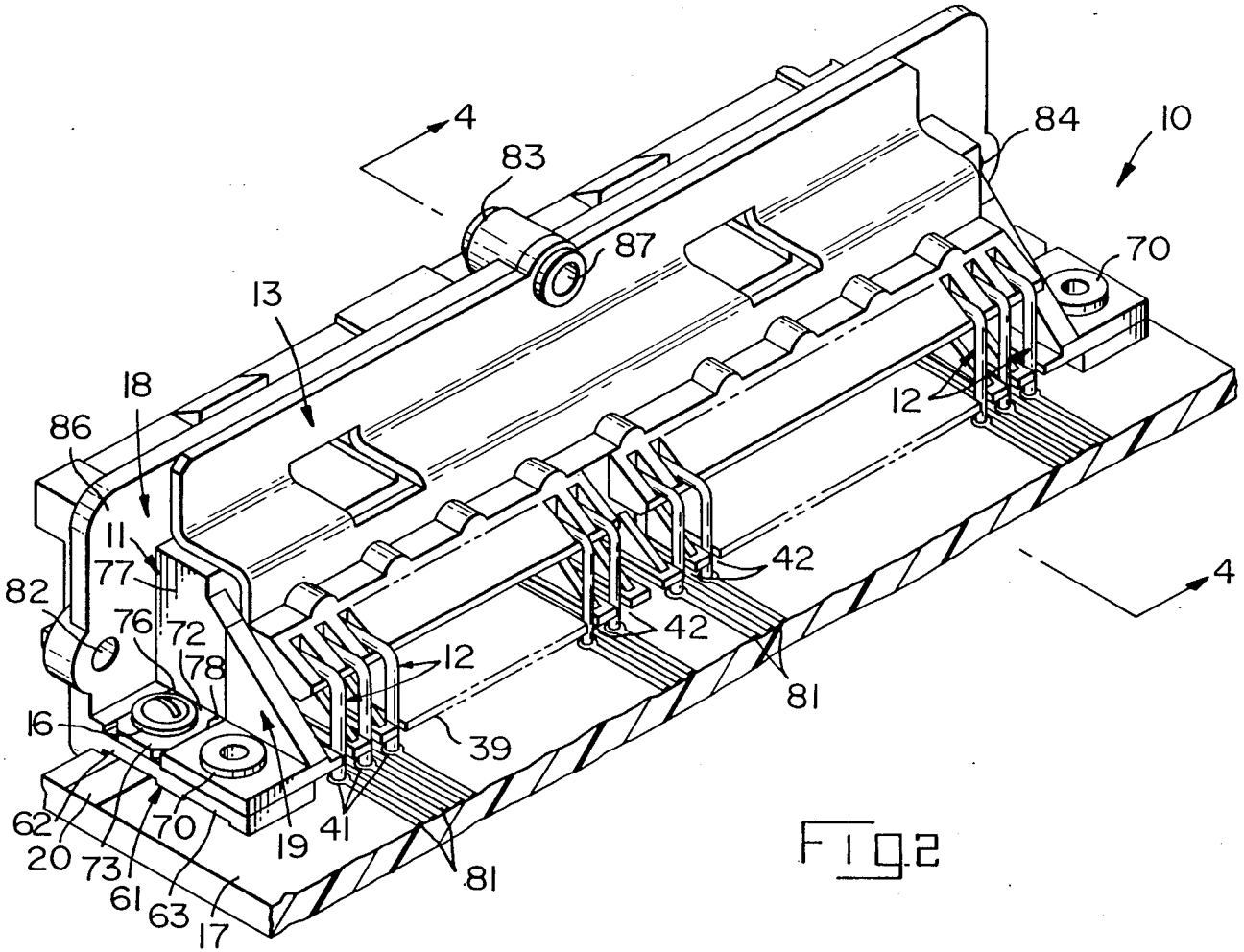
FIG. 2 illustrates the header assembly of FIG. 1 in assembled form and mounted to a circuit board.
Figure 3:
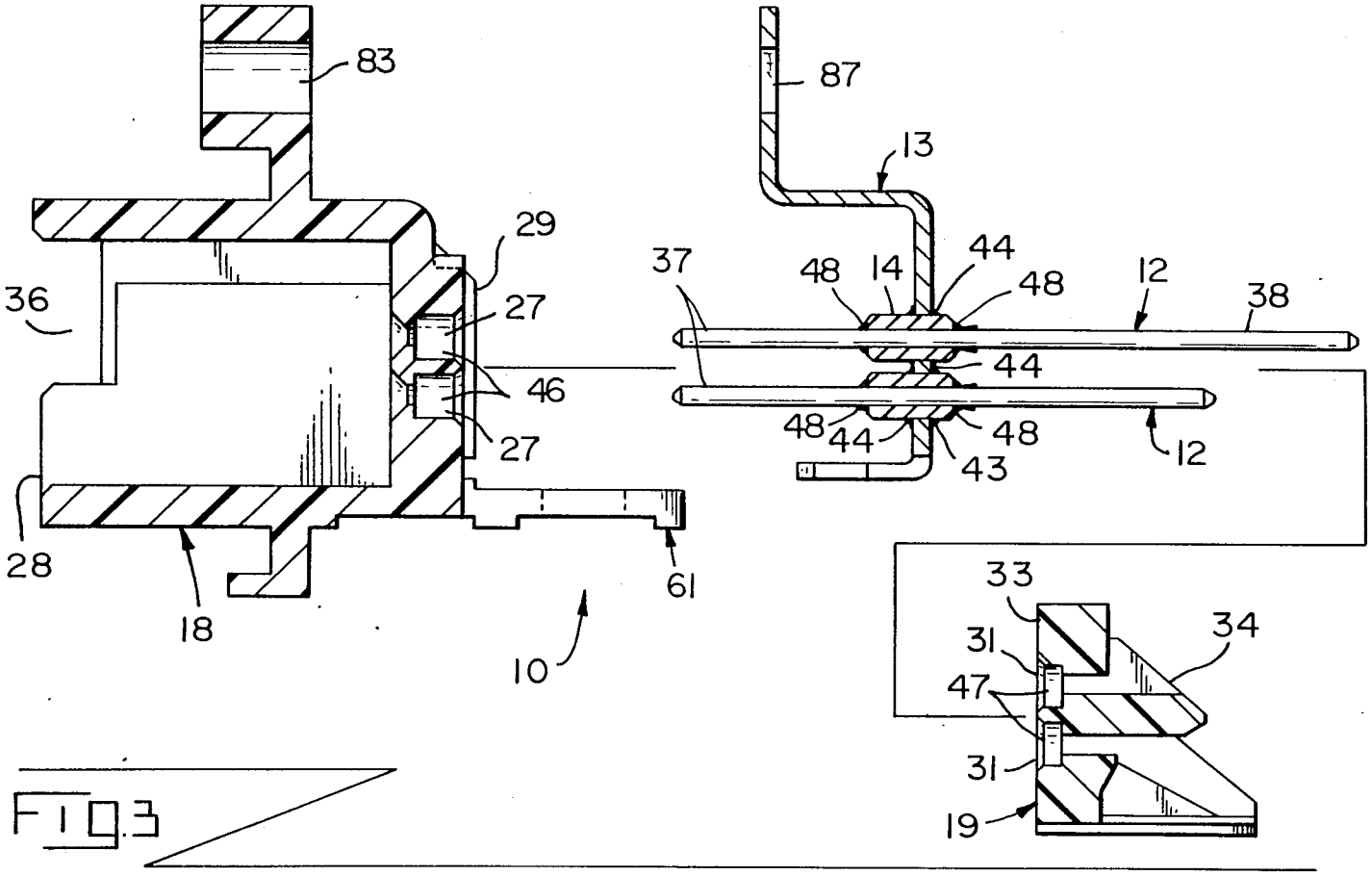
FIG. 3 is an exploded cross-sectional view of the header assembly of FIG. 1 taken along line 3—3 in FIG. 1.

As shown in FIGS. 1 and 3, conductor pins 12 are initially straight; however, after assembly of the housing 11, the ends 38 thereof are bent downwardly at an angle of approximately 90° and extend slightly below bottom surface 39 of housing 11 for insertion into holes 41 in circuit board 17 and into electrical contact with conductors 82 as shown in FIG. 2. As shown in FIGS. 1 and 2, rear housing portion 19 is preferably formed with a plurality of slots 42 positioned to receive the bent ends 38 of pins 12 to help secure and hold the pins in position within the housing.

Grounding plate 13 comprises an elongated plate positioned between housing portions 18 and 19 and is configured to conform to and be in contact with grounding plate receiving surfaces 29 and 33 of housing portions 18 and 19, respectively, when the housing is assembled. Grounding plate 13 is formed of an electrically conductive material, with cold rolled steel being preferred, and is provided with two rows of holes 43 positioned to be aligned with the holes 27 and 31 in housing portions 18 and 19, respectively, after assembly.

All or selected ones of the holes 43 in grounding plate 13 are sized to receive tubular filter elements 14. Tubular filter elements 14 are well-known devices used extensively in electrical circuits to suppress unwanted interference such as EMI or RFI noise. They are available in various sizes and capacities, depending on the particular application. Tubular filter elements are typically of the type disclosed in commonly assigned U.S. Pat. No. Re. 29,258.

Filter elements 14 are preferably secured within holes 43 of grounding plate 13 by a conductive solder 44 as shown in FIGS. 3 and 4 although other conductive securing means such as integral spring fingers inclined slightly toward the hole axes may also be used if desired.

As best shown in FIGS. 3 and 4, holes 27 and 31 in front and rear housing portions 18 and 19 are formed with enlarged portions 46 and 47, respectively, to receive the tubular filter elements 14 therein when the header assembly 10 is assembled.

Conductor pins 12 extend through each of the tubular filter elements 14 and are preferably electrically coupled and secured within their respective filter elements 14 by a conductive solder 48 applied at each end of the filter elements 14 as shown in FIGS. 3 and 4, although other conductive securing means, such as spring fingers formed on the conductor pins as disclosed in U.S. Pat. No. 4,519,665 can also be used, if desired.

As is known to those skilled in the art, the function of grounding plate 13 is to help dissipate the energy filtered by the tubular filter elements 14. The grounding plate itself should also be grounded, and this can be done by electrically connecting the grounding plate to a ground plane 20 on the circuit board 17 as best seen in FIG. 2. In accordance with the present invention, this is accomplished automatically when the header assembly 10 is mounted to the printed circuit board 17.

Specifically, as shown in FIG. 1, front housing portion 18 has a lateral flange 61 extending rearwardly from each side thereof. Each flange 61 includes integral first and second flange portions 62 and 63, each having an aperture 64 and 66, respectively, extending therethrough. Flange portion 62 is slightly thicker than flange portion 63 to define a narrow shoulder 67 there between.

Rear housing portion 19 also includes a pair of lateral flanges 68, each having an aperture 69 extending therethrough. To assemble the front and rear housing portions, rear housing portion 19 is positioned adjacent front housing portion 18 with flanges 68 positioned on top of flange portions 63 such that the apertures 69 are in alignment with apertures 66. The shoulders 67 on flanges 61 assist in positioning the flanges relative to one another for quick alignment of the apertures. As will be explained hereinafter, a pair of fasteners 70 (FIG. 2), which preferably comprise rivets, is extended through the aligned apertures 69 and 66 to fasten the housing portions 18 and 19 together.

Grounding plate 13 includes a pair of grounding flanges 71 (FIG. 1), which are integral with the grounding plate 13 and which extend outwardly from either side thereof. Each grounding flange 71 includes a narrow neck portion 72 and an enlarged outer portion 73, portion 73 being provided with an aperture 74 extending therethrough.

The enlarged outer portions 73 of grounding flanges 71 are positioned and configured to fit upon first flange portions 62 of front housing portion 18 with apertures 74 thereof in alignment with apertures 64 in first flange portion 62. Shoulders 76 formed on the housing portion 18 assist in proper alignment of the apertures. The side walls 77 of front housing portion 18 are also provided with narrow slots 78 through which neck portions 72 of grounding flanges 71 extend when the grounding plate 13 is positioned on front housing portion 18 to help retain the grounding plate on the front housing portion during assembly. Side walls 77 also define shoulder 79 (FIG. 1) which extend slightly beyond grounding plate receiving surface 29 to help position grounding plate 13 on front housing portion 18.

A pair of fasteners 16, preferably rivets (FIG. 2), is adapted to be extended through aligned apertures 74 and 64 to attach grounding plate 13 to front housing portion 18. In addition, however, rivets 16 are also adapted to receive fastening means 65 which are inserted through rivet 16 and into aligned apertures (not shown) in the circuit board 17 to mount the header assembly as a whole to the circuit board as illustrated in FIG. 2. Rivets 16 are formed of electically conductive material and are in contact with grounding flanges 71 of grounding plate 13 and with conductive paths on the circuit board and, thus, function to dissipate energy from the grounding plate 13 to ground through the circuit board.

Thus, with the present invention, when the header assembly 10 is mounted to the circuit board 17, a grounding path is provided from the tubular filter elements 14 through the grounding plate 13, the rivets 16 and fastening means to the ground plane 20 on circuit board 17.

As shown in FIGS. 1 and 2, front housing portion 18 is also provided with a plurality of apertures 82, 83, and 84 extending through vertical wall 85 thereof. These are provided to mount the header assemlby 10 to a face panel or other vertical mounting surface, if required by the particular application in which the header assembly is to be used. Grounding plate 13 is also provided with an aperture 87 positioned to be aligned with aperture 83 when the grounding plate is positioned on front housing portion 18. Aligned apertures 83 and 87 are adapted to receive a rivet and fastening means (not shown) to mount the assembly to a vertically oriented mounting surface thus providing a grounding path through the rivet and fastening means from the grounding plate to the vertical mounting surface when such a mounting is required.

The header assembly 10 is assembled and mounted to a circuit board as follows:

Initially, the conductor pins 12 (which are initially straight) are inserted through the tubular filter elements 14 and soldered thereto as shown at 48. The filter elements are then inserted into holes 43 in grounding plate 13 and soldered in position by solder 44. The grounding plate 13 is then positioned on front housing portion 18 against grounding plate receiving surface 29. The conductor pins 12 will extend through holes 27 in front housing portion 18, and the filter elements 14 will extend into enlarged portions 46 of the holes 27. Grounding flanges 71 will also be positioned on flange portions 62 of housing portion 11 with apertures 74 thereof aligned with apertures 64 in the flange portions 62. Neck portions 72 of the grounding flanges will extend through slots 78 to also help retain the grounding plate in position.

It is not necessary that each conductor pin have a filter element connected thereto. Depending on the particular application in which the header assembly is to be used, it may be desired not to filter one or more of the circuits connected through the header assembly. Thus, selected holes. e.g., holes **43*a* in grounding plate 13 (FIG. 1) may be of reduced diameter to receive conductor pins only. These pins may be soldered to plate 13** to ground the pins, or insulated from contact therewith if desired. It is also to be understood that mechanical means may be used to retain and ensure electrical interconnection between the filer elements and the grounding plate.

The grounding plate 13 is attached to front housing portion 18 by means of conductive rivets 16 extending through aligned apertures 74 and 64 in the grounding flange 71 and front housing portion 18 respectively. In addition the grounding plate may also be attached by a conductive rivet 16 through aligned apertures 83 and 87 on the front housing means respectively.

With the grounding plate 13 in position on front housing portion 18, rear housing portion 19 then placed on front housing portion with flanges 68 thereof positioned on flange portions 63 to align apertures 66 and 69. Conductor pins 12 will extend through holes 31 in housing portion 19, and tubular filter elements 14 will extend into enlarged portions 47 of holes 31. The housing portions 18 and 19 are then attached together by rivets 70 extended through aligned apertures 66 and 69.

The lower row of conductor pins 12 is then bent downwardly at an angle of about 90° an locked in place within slots 42 in rear housing portion 19, and then the upper row of pins is bent downwardly at 90° and locked in position in slots 42 to complete the connector assembly 10. In some applications, the pins 12 need not be bent but are left straight.

The header assembly 10 is then mounted on circuit board 17 by conductive fastening means 75 which are inserted through conductive rivets 16 and into aperture 41 on circuit board 17, thus providing a grounding path from the grounding plate 13 to the ground plane 20 on circuit board 17.

In addition to providing a grounding path to the circuit board, the metal grounding plate 13 which extends over portion of the front housing also functions to increase the effectiveness of the shielding from radiant interference.

Figure 4A:
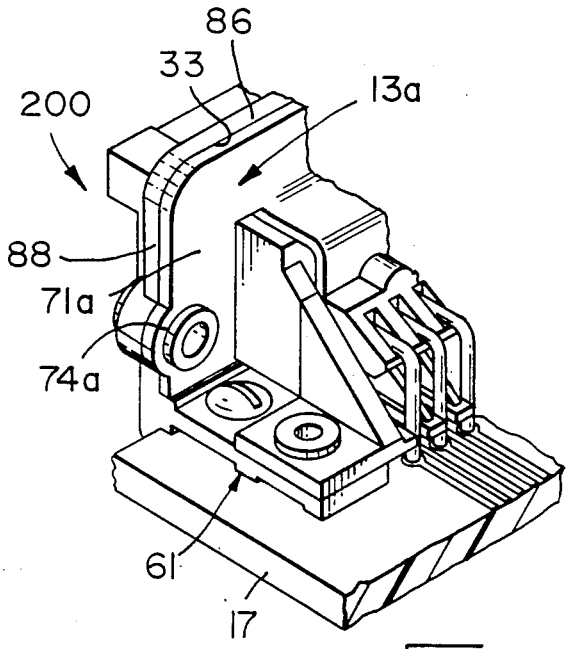
FIGS. 4A and 4B are fragmentary perspective views of alternative embodiments of the header assembly mounted to circuit boards.
Figure 4B:
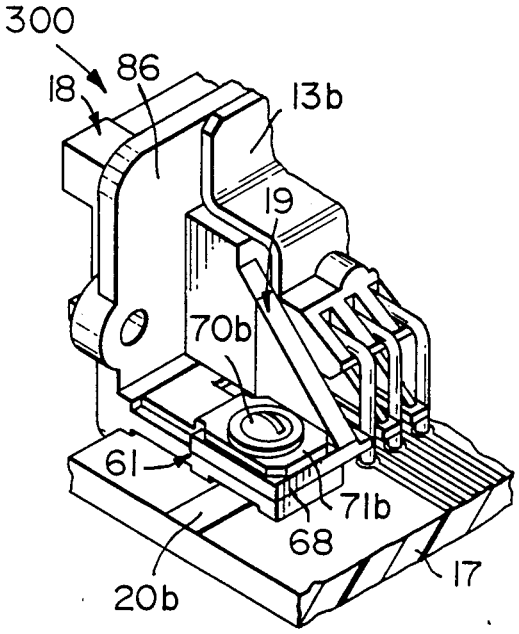

FIGS. 4A and 4B show alternative embodiments 200, 300 for the header assembly. The header asembly 200 in FIG. 4A differs from the assembly of FIGS. 1 to 4 in that it incorporates grounding plate **13*a* which provides a means for mounting the assembly 200 to a face plate or vertically oriented mounting surface (not shown) instead of the circuit board 17. Ground plate 13*a* has grounding flanges 71*a* which are integral with the plate 13*a* and which extend along the sides of plate 13*a*, said flanges being configured to lay against a portion 88 of the vertical wall 86 ground plate receiving surface 33 of front housing 18. That extends beyond side walls 77. Flanges 71*a* further have apertures 74*a* which align with housing apertures 82 when connector 100 is assembled. Preferably conductive rivets 16 are used to join ground plate 13 to front housing member 18. Conductive mounting means (not shown) are inserted through rivets 16 to attach connector 100** to a mounting panel (not shown) in a manner as previously described.

The header assembly 300 of FIG. 4B differs from the assembly of FIGS. 1 to 4 in that it incorporated grounding plate **13*b* which has a grounding flange 71*b* extending rearwardly from the sides thereof. Grounding flanges 71*b* are positioned and configured to fit upon lateral flanges 68 of rear housing portion 19. Flanges 71*b* have aperture 74*b* which align with apertures 69 and 66 (not shown) in rear and front housing portions 18, 19 respectively. Conductive fasteners 70*b*, preferably rivets extend through the three aligned apertures thus enabling housing portions 18, 19 and grounding plate 13*b* to be joined together in one operation. Conductive fastening means (not shown) can be used to mount the assembly 300 to circuit board 17 and provide a grounding path between plate 13*b* and ground plane 20*b* on circuit board 17**.

Figure 5:
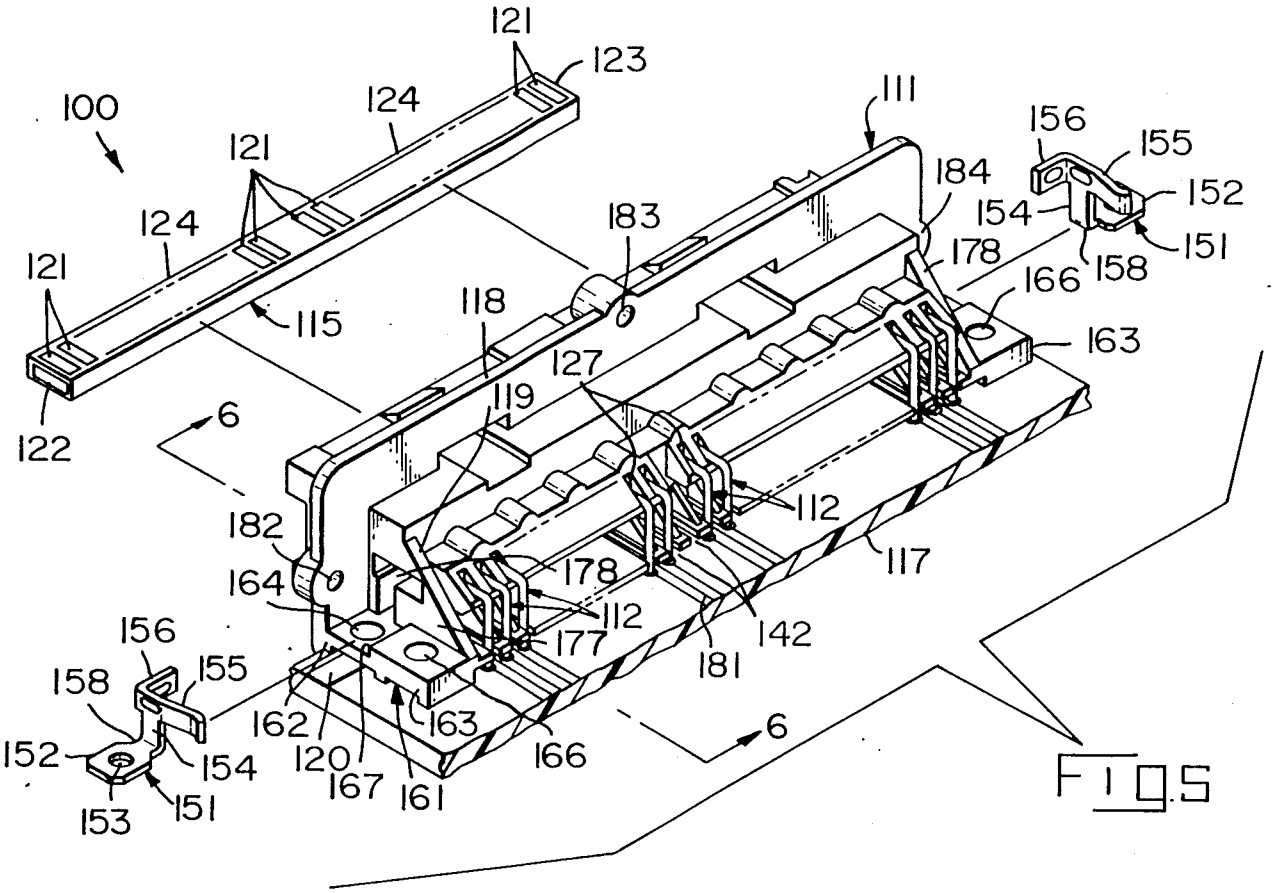
FIG. 5 is an exploded perspective view of a filtered header assembly according to a second presently preferred embodiment of the invention.
Figure 6:
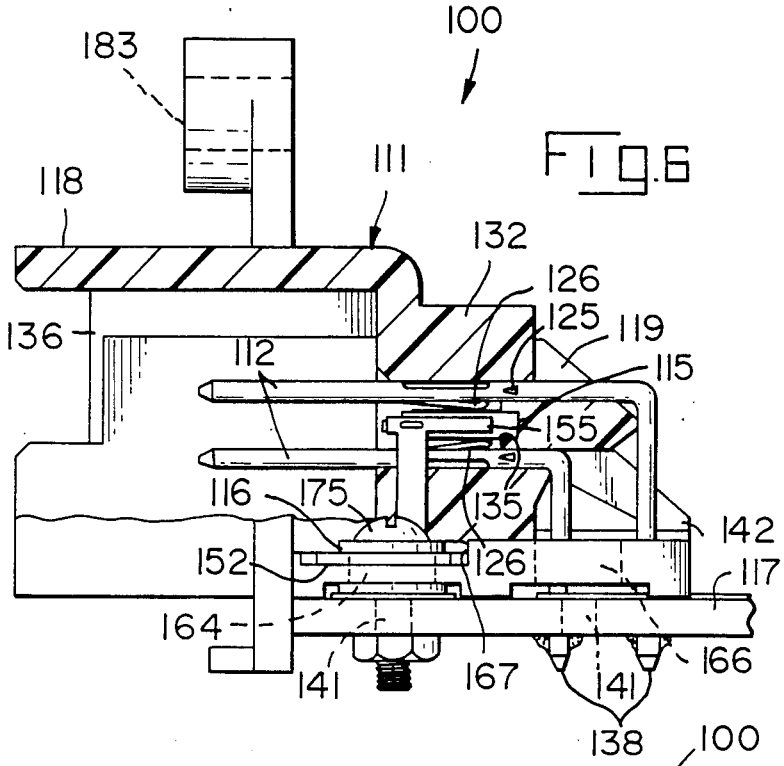
FIG. 6 is a cross-sectional view of the header assembly of FIG. 5 in assembled form and mounted to a printed circuit board and taken along line 6—6 in FIG. 5.
Figure 7:
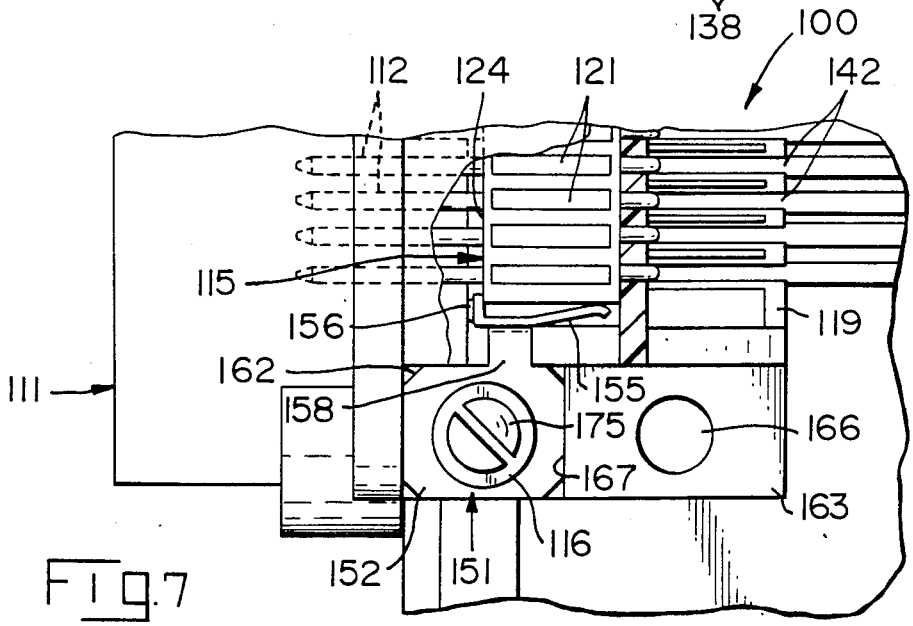
FIG. 7 is a partial cross-sectional view of the header assembly of FIG. 5 to more clearly illustrate details in the construction thereof.

FIGS. 5 to 7 illustrate a second presently preferred embodiment of the invention. The header assembly of FIGS. 5 to 7 differs from the header assembly of FIGS. 1 to 4 in that it incorporates a monolithic planar capacitor filter to filter EMI and RFI interference rather than tubular filter elements as in the embodiment of FIGS. 1 to 4.

The header assembly of FIGS. 5 to 7 is generally designated by reference numeral 100 and includes a housing 111, a plurality of terminals comprising conductor pins 112 supported within the housing, filter means comprising a monolithic planar capacitor 115 in electrical contact with the conductor pins 112, grounding means comprising a pair of grounding clips 151 and fasteners comprising a pair of rivets 116 (FIG. 7) for mounting the assembly 100 to a circuit board 117 or other support surface. As will be explained hereinafter, rivets 116 also function to attach the grounding clips 151 to housing 111 and to provide a grounding path from the grounding clips 151 to the circuit board 117.

Unlike the embodiments of FIGS. 1 to 4, housing 111 is of one-piece construction. As in the previous embodiment, it is formed of a dielectric material. Also, the size and external configuration of housing 111 is essentially identical to that of housing 11 as well as to the housing in U.S. Pat. No. 4,491,376 to provide standardization such that either header assembly embodiment can be used interchangeably on standardized circuit boards and with standardized mating connectors.

Housing 111 is provided with two rows of holes 127 which extend through the housing, as shown in FIG. 6, and which are adapted to receive conductor pins 112. Pins 112, are each preferably formed from a suitable metal and include an integral spring finger 126 substantially centrally thereon. These pins which are initially straight, may be bent either before or after insertion. Alternatively the pins may remain straight. Spring fingers 126 are formed in a manner known in the art by flattening the central areas of the conductor pins and stamping the spring fingers therefrom, and their manner of construction need not be described in detail herein. In addition, pins 112 preferably have a hole embossed at 125 to provide an interference fit within 127 to limit movement of pins 112 within the holes.

Housing 111 has a substantially solid body portion 132. A front portion 118 defining a pair of sockets 136 adapted to receive mating connector members (not shown), and a rear portion 119. A slot 135 extends into body portion 132 from the inside face of the sockets between and in communication with the two rows of holes 127; and monolithic planar capacitor 115 is positioned in slot 135. Monolithic planar capacitors are commonly used in electrical filtering applications and need not be described in detail herein. They are available from a number of companies, depending on the particular filtering characteristics desired and other properties of the filter. Examples of monolithic planar capacitors are also disclosed in U.S. Pat. Nos. 4,126,840 and 4,376,922.

The monolithic planar capacitor 115 is positioned within the slot 135 in housing 111 such that when the two rows of conductor pins 112 are inserted into holes 127, the spring fingers 126 thereon will electrically contact and press against an aligned pad 121 on the monolithic planar capacitor as best shown in FIG. 6.

Grounding within the planar capacitor 115 is run to the outer end pads 122 and 123 thereof, and grounding means in the form of a pair of grounding clips 151 are placed in contact with the end pads 122 and 123. Preferably two grounding clips 151 are used to provide redundancy, however, it is to be understood that only one end of the planar capacitor needs to be grounded. Specifically, as best shown in FIG. 5, grounding clips 151 each include a horizontal grounding flange 152 which includes an enlarged portion having an aperture 153 extending therethrough and a narrow neck portion 158. In addition, each grounding clip 151 includes a vertical portion 154 having a spring member 155 and a tab member 156 extending horizontally from the top end thereof substantially perpendicular to one another. Grounding clips are of integral one-piece construction and can be made in a known manner of a variety of conductive materials with a copper alloy such as a phosphor bronze alloy being preferred.

As best shown in FIG. 5, housing 111 includes side walls 177 which are cut to define slots 178 extending therethrough an in communication with the bottom ends thereof. The grounding clips 151 are positioned on the housing 111 such that neck portion 158 of horizontal grounding flanges 152 extend through the slots 178, the enlarged portions of grounding flanges 152 are positioned externally of side walls 177, and the vertical portions 154 are positioned internally of side wall 177.

Housing 111 includes a pair of flanges 161 extending from either side thereof with each flange 161 having a first flange portion 162 and a second flange portion 163. Flange portions 162 and 163 each have an aperture 164 and 166, respectively, extending therethrough, and second flange portion 163 is somewhat thicker than first flange portion 162 to define a shoulder therebetween.

When grounding clips 151 are positioned in housing 111, the enlarged portions of horizontal grounding flanges 152 will be positioned on flange portions 162 of housing 111 with apertures 153 thereof aligned with apertures 164. Shoulders 167 on flanges 161 assist in positioning of the clips. The vertical portions 154 of the clips 151 will extend upwardly within the housing 111 as shown in FIGS. 6 and 7, and spring arms 155 will contact and press against the end pads 122 and 123 of the monolithic planar capacitor 115 to provide electrical contact between the end pads 122 and 123 and the grounding clips 151. Since the clips are conductive, the energy filtered by the capacitor will be transmitted from the end pads 122 and 123 of the capacitor into the grounding clips 151.

A pair of rivets 116 is inserted through the aligned apertures 153 and 164 in the grounding clips 125 and in the housing flange portions 164. The rivets 116 are also adapted to receive conductive fastening means 175 which are inserted through the rivets 116 and into aligned apertures 141 in the circuit board 117 (FIG. 6) to mount the header assembly 100 on the circuit board, and to provide a grounding path from the grounding clips through the rivets to grounding plane 120 on circuit board 117.

As indicated above, grounding clips 151 each include a tab portion 156 extending from vertical portion 154 in a direction substantially perpendicular to sping portion 155. As shown in FIG. 7, the tab portions 156 are adapted to extend in front of edge 124 of the monolithic planar capacitor 115 to retain the capacitor in its respective slot and to prevent it from falling out of the housing 11.

With the embodiment illustrated in FIGS. 5–7, a filtered header assembly is provided which contains a pair of grounding clips 151 which contact the grounding end pads 122 and 123 of monolithic planar capacitor 115, to hold the monolithic planar capacitor in position with the header assembly and to provide a conductive path from the capacitor to the circuit board for grounding purposes. In both the embodiments of FIGS. 1–4 and 5–7, the filtering capability is incorporated into the housing of the header assembly without changing the external configuration or size of the housing to an extent that affects standardization or that will prevent the header assembly from being used with standardized circuit boards and with standardized mating connector members.

In both embodiments also the grounding means are designed such that grounding to the printed circuit board is automatically provided when the header assembly is mounted to the printed circuit board. No additional assembly steps or redesign of the header assembly for this purpose is required. In the embodiment of FIGS. 5–7, the holes 166 in housing flange portions 163 may also be used to mount the assembly to the circuit board, if desired; and, as in the previous embodiment, vertically oriented holes 182, 183, and 184 may also be provided to mount the header assembly to a face plate or another vertically oriented mounting surface when appropriate for the particular application.

The header asembly 100 is assembled and mounted to a printed circuit board as follows:

Conductor pins 112, which may be straight, are inserted through holes 127 in housing 111, the pins preferably being embossed at 125 to provide an interference fit within holes 127. The ends 138 (FIG. 6) of the pins are then bent downwardly at an angle of about 90° and locked in position in slots 142 (FIGS. 7) formed in rear portion 119 of the housing 111 as in the previous embodiment. Alternatively prebent pins may be inserted through holes 127 and locked into position in slots 142. Monolithic planar capacitor 115 is then inserted into its respective slot 135 in the housing between the rows of conductor pins such that the spring fingers 126 on each pin will electrically contact and press against one of the pads 121 on the capacitor 115. Grounding clips 151 are positioned within the housing such that spring fingers 155 thereof will press against end pads 122 and 123 of the capacitor to provide a conducting path from pads 122 and 123 to the grounding clips. Tabs 156 of clips 151 will extend in front of edge 124 of capacitor 115 to help prevent the capacitor from backing out of its respective slot.

The grounding clips 151 are attached to housing portion 118 by means of conductive rivets 116 extending through aligned apertures 153 and 164 in the grounding clips 151 and housing flange 162 respectively. The header assembly 100 can then be mounted to circuit board 117 by extending conductive fastening means 175 through rivets 116 and aperture 141 on circuit board 117 respectively, thus providing a grounding path from grounding clips 151 to ground plane 120 on circuit board 117.

While what has been described constitute presently most preferred embodiments of the invention, it should be recognized that the invention could take many other forms. Accordingly, it should be understood that the invention is to be limited only insofar as is required by the scope of the following claims.

We claim:

1. A filtered electrical connector comprising:

a housing means having at least one cavity therein, said housing means including a front housing portion and a rear housing portion, one of said housing portions including a pair of flange portions, each having an aperture extending therethough;

a conductive grounding plate supported between said front and rear housing portions, said grounding plate having a plurality of apertures therein for receiving a plurality of tubular filter elements in conductive contact with said grounding plate, said grounding plate further including a pair of integral grounding flanges, said grounding flanges each having an aperture extending therethrough, said apertures being aligned with corresponding apertures in said housing flange portions;

a plurality of electrical terminal members, each extending through a respective tubular filter element in conductive contact with its respective tubular filter element, said members being supported with said housing means and said tubular filter elements being mechanically and electrically secured in said filter receiving apertures of said grounding plate; and conductive means comprising a first fastening means extending through each of said aligned apertures in said grounding plate flanges and said housing portion flanges for connecting said grounding plate to said housing portion and a second fastening means extending through said first fastening means for providing means for mounting said connector to a circuit board, and a grounding path from said grounding plate through said conductive means to said circuit board.

2. The electrical connector as described in claim 1 wherein said conductive fasteners comprise rivets.

3. The electrical connector as described in claim 1 wherein said grounding plate also functions as a shield to reduce the amount of radiant interference passing through said electrical connector.

4. A filtered electrical connector comprising:

a housing having at least one cavity therein;

a plurality of conductor pins supported within said housing;

a monolithic planar capacitor in said at least one housing cavity in electrical contact with said plurality of conductor pins;

a conductive grounding clip in contact with a grounding end of said monolithic planar capacitor, said grounding clip including a grounding flange having an aperture extending therethrough aligned with a mounting aperture in said housing, said grounding clip further including a tab portion for retaining said monolithic planar capacitor with said housing; and a conductive means extending through said aligned apertures and through apertures in a circuit board for attaching said grounding clip to said housing for mounting said housing to said circuit board and for providing a grounding path from said monolithic planar capacitor through said grounding clips and said fasteners to said printed circuit board.

5. The electrical connector as described in claim 4 wherein said grounding clip includes a spring portion for contacting said grounding end of said monolithic planar capacitor.

6. The electrical connector as described in claim 4 wherein said conductive means comprises a conductive rivet extending through said aligned aperture and a conductive fastening means extending through said rivet and through said aperture in said circuit boad.

7. An electrical connector for connection to a circuit board, comprising:

dielectric housing means having a plurality of terminal-receiving passageways extending therethrough, said housing including at least one mounting aperture;

electrical terminal means disposed in said terminal-receiving passageways and electrically connectable to conductive means on the circuit board;

filter means electrically coupled to at least some of said electrical terminal means;

grounding means electrically coupled to said filter means, said grounding means including at least one aperture, in alignment with said at least one housing aperture;

means provided by said housing means and said grounding means for maintaining said filter means in position in said housing means; and conductive means comprising first fastening means for attaching said grounding means to said housing means through said aligned apertures and for mounting said connector onto the circuit board and second fastening means which cooperate with first fastening means providing a grounding path from said grounding means to a ground plane on the circuit board.

8. The electrical connector as described in claim 7 wherein said first fastening mans comprises at least one rivet extending through said aligned apertures, said rivet having an aperture therein for receiving said second fastening means.

9. The electrical connector as described in claim 7 wherein said terminal means comprises a plurality of conductor pins and wherein said filter means comprises a plurality of tubular filter elements surrounding said plurality of conductor pins and in electrical contact therewith.

10. The electrical connector as described in claim 9 wherein said grounding means comprises a grounding plate having a plurality of holes extending therethrough, said plurality of tubular filter elements being mounted in said plurality of holes to provide electrical contact between said plurality of tubular filter elements and said grounding plate.

11. The electrical connector as described in claim 10 and further including conductive solder for attaching said plurality of tubular filter elements within said plurality of holes in electrical contact with said grounding plate.

12. The electrical connector as described in claim 10 wherein said housing means includes a first front housing portion and a second rear housing portion and wherein said grounding plate is supported between said first and second housing portions.

13. An electrical connector for connection to a circuit board, comprising:

dielectric housing means having a plurality of terminal receiving passageways extending therethough;

electrical terminal means disposed in said terminal-receiving passageways and electrically connectable to conductive means on the circuit board, said terminal means comprising a plurality of conductor pins;

filter means electrically coupled to at least some of said electrical terminal means, said filter means comprising a plurality of tubular filter elements surrounding said plurality of conductor pins and in electrical contact therewith;

grounding means electrically coupled to said filter means, said grounding means comprising a grounding plate having a plurality of apertures extending therethrough, said plurality of tubular filter elements being mounted in said plurality of apertures to provide electrical contact between said plurality of tubular filter elements and said grounding plate, said grounding plate including first and second grounding flanges extending therefrom and integral therewith, said first and second grounding flanges each having an aperture extending therethrough aligned with corresponding apertures in said housing means;

means provided by said housing means and said grounding means for maintaining said filter means in position in said housing means; and conductive means for attaching said grounding means to said housing means, said conductive means comprising conductive first fastening means extending through at least one of said aligned flange and housing apertures, and second conductive fastening means which extend through said first fastening means and into an aperture in a circuit board for simultaneously mounting said housing means to said circuit board and for providing a grounding path from said grounding plate through said first fastening means to a ground plane on said circuit board.

14. The electrical connector as described in claim 13 wherein said housing means includes a first front housing portion and a second rear housing portion and wherein said grounding plate is supported between said first and second housing portions.

15. An electrical connector for connection to a circuit board, comprising:

dielectric housing means having a plurality of terminal-receiving passageways extending therethrough;

electrical terminal means disposed in said terminal-receiving passageways and electrically connectable to conductive means on the circuit board;

filter means electrically coupled to said electrical terminal means, said filter means comprising at least one monolithic planar capacitor electrically coupled to said electrical terminal means;

grounding means electrically coupled to said filter means;

means provided by said housing means and said grounding means for maintaining said filter means in position in said housing means;

conductive means for attaching said grounding means to said housing maens and for mounting said housing means onto the circuit board and for providing a grounding path from said grounding means to a ground plane on the circuit board; and said housing means and said grounding means each including at least one aperture positioned in alignment with one another for accepting said conductive means, said conductive means comprising a first fastening means extending through said at least one aligned aperture of said housing means and said grounding means and a second fastening means extending through said first fastening means, said second fastening means being engageable with an aperture of said circuit board to mount said connector thereto.

16. The electrical connector as described in claim 15 wherein said plurality of terminals comprise a plurality of conductor pins, each of said plurality of conductor pins including spring finger portions for electrically contacting said monolithic planar capacitor.

17. The electrical connector as described in claim 16 wherein said grounding means comprises a pair of grounding clips, one of said grounding clips being in electrical contact with the grounding ends of said monolithic planar capacitor, each of said grounding clips including a grounding flange having an aperture extending therethrough aligned with an aperture in said the circuit board and for providing a grounding path from said grounding means to a ground plane on the circuit board; and said housing means and said grounding means each including at least one aperture positioned in alignment with one another for accepting said conductive means, said conductive means comprising a first fastening means extending through said at least one aligned aperture of said housing means and said grounding means and a second fastening means extending through said first fastening means, said second fastening means being engageable with an aperture of said circuit board to mount said connector thereto.

18. The electrical connector as described in claim 15 wherein said grounding means comprises at least one grounding clip in electrical contact with a grounding end of said at least one monolithic planar capacitor, said grounding clip including a grounding flange having an aperture extending therethrough aligned with an aperture in said housing means.

19. The electrical connector as described in claim 18 wherein said grounding clip includes a tab portion extending in front of said monolithic planar capacitor for retaining said monolithic planar capacitor within said housing means.

20. The electrical connector as described in claim 18 wherein said grounding clip includes a spring portion for providing electrical contact with the grounding end of said monolithic planar capacitor.

21. The electrical connector as described in claim 20 wherein said grounding clip further includes a tab portion extending in front of said monolithic planar capacitor for retaining said monolithic planar capacitor within said housing means.

22. The electrical connector as described in claim 20 wherein said housing means includes a slot for receipt of asid monolithic planar capacitor.

* * * * *